United States Patent [19]

Johnson

[11] Patent Number: 5,004,244

[45] Date of Patent: Apr. 2, 1991

[54] MEMORY GAME

[76] Inventor: Gary K. Johnson, 10701 W. 71st Pl., Shawnee, Kans. 66203

[21] Appl. No.: 570,605

[22] Filed: Aug. 20, 1990

[51] Int. Cl.[5] ..... A63F 3/00

[52] U.S. Cl. ..... 273/240; 273/249; 273/272

[58] Field of Search ..... 273/240, 249, 237, 272, 273/243

[56] References Cited

U.S. PATENT DOCUMENTS

| | | | |
|---|---|---|---|
| 3,606,336 | 9/1971 | Krause | 273/272 |
| 4,014,548 | 3/1977 | Trilling | 273/272 |
| 4,468,035 | 8/1984 | Slepian | 273/272 |
| 4,509,758 | 4/1985 | Cole | 273/272 |
| 4,741,538 | 5/1988 | Lewis | 273/272 |
| 4,807,878 | 2/1989 | Tripp | 273/237 |
| 4,852,885 | 8/1989 | Barantpour et al. | 273/272 |
| 4,854,594 | 8/1989 | Eaton | 273/249 |
| 4,900,031 | 2/1990 | Wohl | 273/243 |
| 4,911,452 | 3/1990 | Marchese | 273/240 |

*Primary Examiner*—Benjamin Layno

*Attorney, Agent, or Firm*—Litman, McMahon & Brown

[57] ABSTRACT

A memory development game apparatus including a game board, a playing token, a die, scoring sheets, a timer, a spinner, and initial selection and pairing means comprising a deck of cards and a gaming piece. During a given time interval, players competitively record the names of known persons or personalities, each of which has a first and last name with initials which matches one pair of a plurality of pairs of initials established for a round of play. The point value allowed for each named person or personality is determined by a people category which characterizes that particular person or personality. The value for each category is established by moving the token along the board as indicated by a roll of the die and observing the indicia recorded on the space occupied by the token. The value for each category differs for each round of play. The player having the highest cumulative score is declared winner.

10 Claims, 3 Drawing Sheets

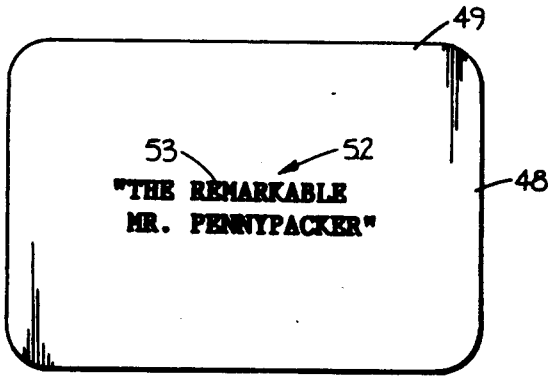
Fig.3a.
Fig.3b.
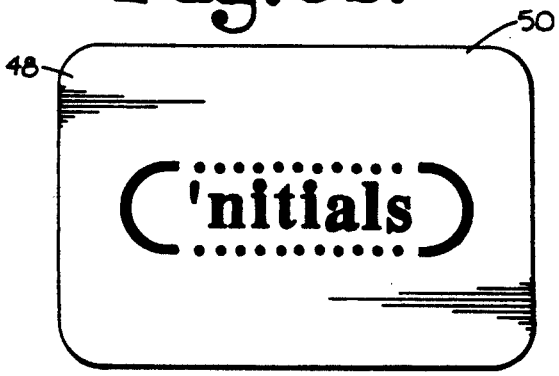
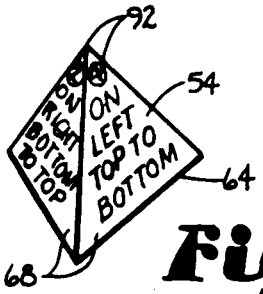
Fig.4.
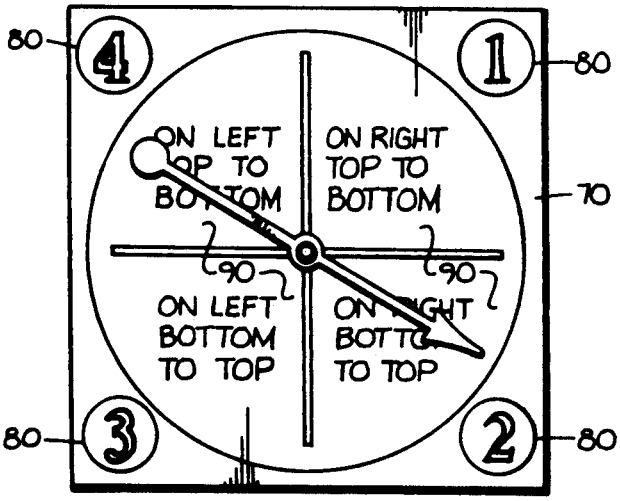
Fig.7.
Fig.6.
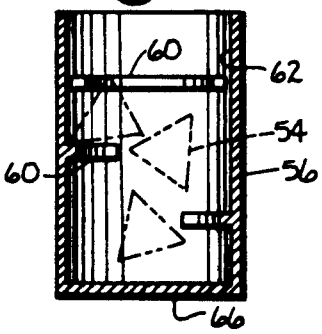
Fig.5.
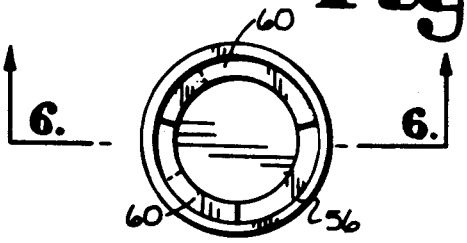
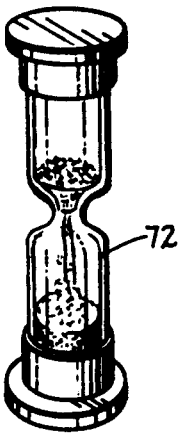
Fig.8.

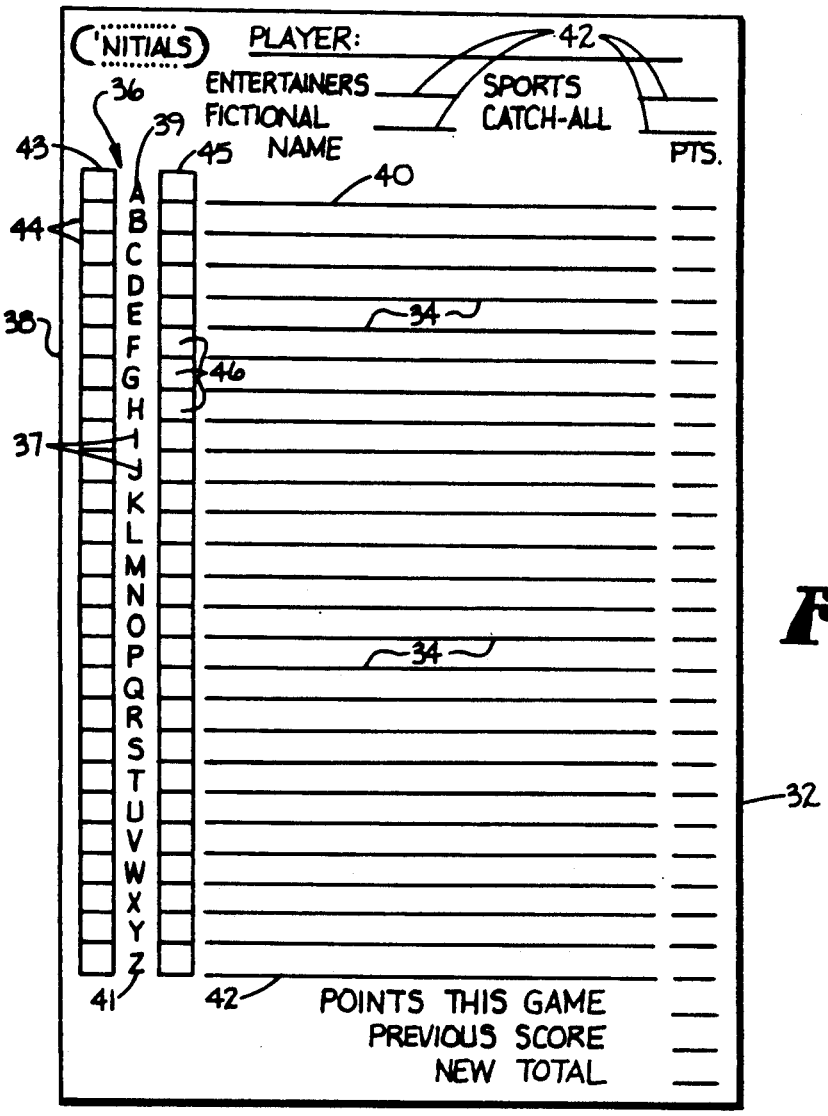
Fig. 9.
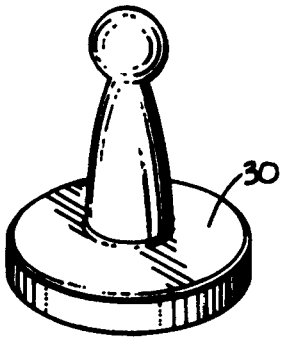
Fig. 10.
Fig. 11.
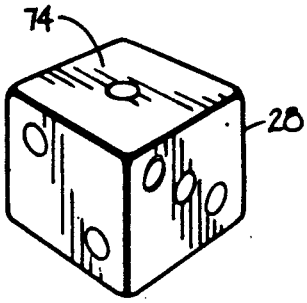

MEMORY GAME

BACKGROUND OF THE INVENTION

1. Field of the Invention

The present invention relates to games and, more particularly, to a memory development game wherein players associate pairs of initials with names of known persons or personalities.

2. Description of the Relevant Art

Numerous types of games are well known in the prior art. Most of such games usually focus primarily on the entertainment aspect provided by the playing thereof. A concern commonly voiced by many individuals involves the difficulty of recollecting someone's name. Various memory development techniques are generally readily available, such as in the library or in the marketplace. Many of these techniques focus on associating the name or object to be remembered by association with another object, letter or word. An individual consistently applying such a technique over a period of time can develop a greater awareness of and a "hook" for remembering newly heard names and thereby develop an enhanced memory recollection ability.

What is needed is a game which is not only entertaining, but which also provides a simple routine for developing one's awareness of easily recallable characteristics of acquaintances' names.

SUMMARY OF THE INVENTION

In the application of the apparatus and method of the present invention, an entertaining game is combined with a technique for improving one's ability to recollect the names of acquaintances by developing an awareness of the initials of the acquaintance's first and last names and mentally associating the acquaintance's name with his or her initials.

The game is played by one or more players. A die is rolled to indicate the number of squares to advance a marker token along a path on a game board. Except for a start square and a finish or "last chance" square, each of the squares contains indicia designating various people categories of persons or personalities with each of the categories being assigned a different point value. The point value of each category varies from square to square.

Each player has a score sheet which contains a plurality of vertically aligned horizontal lines. A first column of characters comprising alphabetic characters is spaced near the left margin of the score sheet such that one of each of the alphabetic characters in the column is associated with a different one of the vertically aligned horizontal lines. Spaced immediately to the left of the first column containing the alphabetic characters is a second column which contains several vertically aligned blank boxes, equal in number to the number of alphabetic characters in the first column. Similarly, a third column of blank boxes, substantially identical to the second column, is spaced immediately to the right of the first column.

A card is drawn from a shuffled deck, each card of which contains a phrase or ordered array of alphabetic characters, equal in number to the number of alphabetic characters in the first column. A toss of a gaming piece or a flick of a spinner then prescribes whether the alphabetic characters on the drawn card are to be entered in the second column or in the third column and, further, whether they are to be entered from top to bottom or from bottom to top.

After the alphabetic characters are properly entered on each player's score sheet, a timer is started to begin the round of play. Each player then competitively lists names of known persons or personalities on each line of his score sheet. To be a valid entry, the initials of the first and last names entered on a particular line on the score sheet must respectively correspond with the two alphabetic characters at the beginning of that line.

After the time interval for listing names on the score sheet has expired, each player records the score for each listed name by determining the appropriate category for each listed name and assigning the appropriate value thereto, as provided in the square occupied by the marker token on the game board. The sum of the values for the listed names for each player is his score for that round.

Successive rounds of play are completed by advancing the marker token additional squares as indicated by another roll of the die and repeating the various steps as aforedescribed. The sums for previous rounds are accumulated to obtain the total score for each player.

Final round of play occurs when a roll of the die indicates advancement of the marker token to or beyond the finish or "last chance" square on the game board. The gaming piece or the spinner is then used to select one of the final-round indicia: 1, 2, 3, or 4. The corresponding people category values, as designated by the preceding square containing the identical final-round indicia, are used for the final round of play. After completion of the final round of play, the player having the highest cumulative score is then declared winner.

OBJECTS OF THE INVENTION

Therefore, the objects of the present invention are: to provide a game which provides users or players an opportunity to develop an enhanced ability to recall other persons' names; to provide such a game which promotes name association with a pair of initials; to provide such a game which mandates such association within a certain time limit; to provide such a game which provides a spirit of competitiveness between players; to provide such a game which is based primarily on skill and secondarily on chance; to provide such a game which is simple to learn, easy to play, instructive, and stimulating intellectually; to provide such a game which may be easily and efficiently manufactured and marketed; to provide such a game which is of durable and reliable construction; and to otherwise provide such a game which generally performs the requirements of its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 3*a* is an enlarged front plan view of a card of the memory game apparatus.

FIG. 3*b* is an enlarged rear plan view of a card of the memory game apparatus.

FIG. 4 is an enlarged perspective view of a gaming piece of the memory game apparatus.

FIG. 5 is a top plan view of a tumbler of the memory game apparatus.

FIG. 6 is an enlarged cross-sectional view of a tumbler of the memory game apparatus taken along line 6—6 of FIG. 5.

FIG. 7 is an enlarged top plan view of a spinner of the memory game apparatus.

FIG. 8 is a perspective view of a timer of the memory game apparatus.

FIG. 9 is a plan view of a score sheet of the memory game apparatus.

FIG. 10 is an enlarged perspective view of a marker token of the memory game apparatus.

FIG. 11 is an enlarged perspective view of a die of the memory game apparatus according to the present invention.

DETAILED DESCRIPTION OF THE INVENTION

Figure 1:
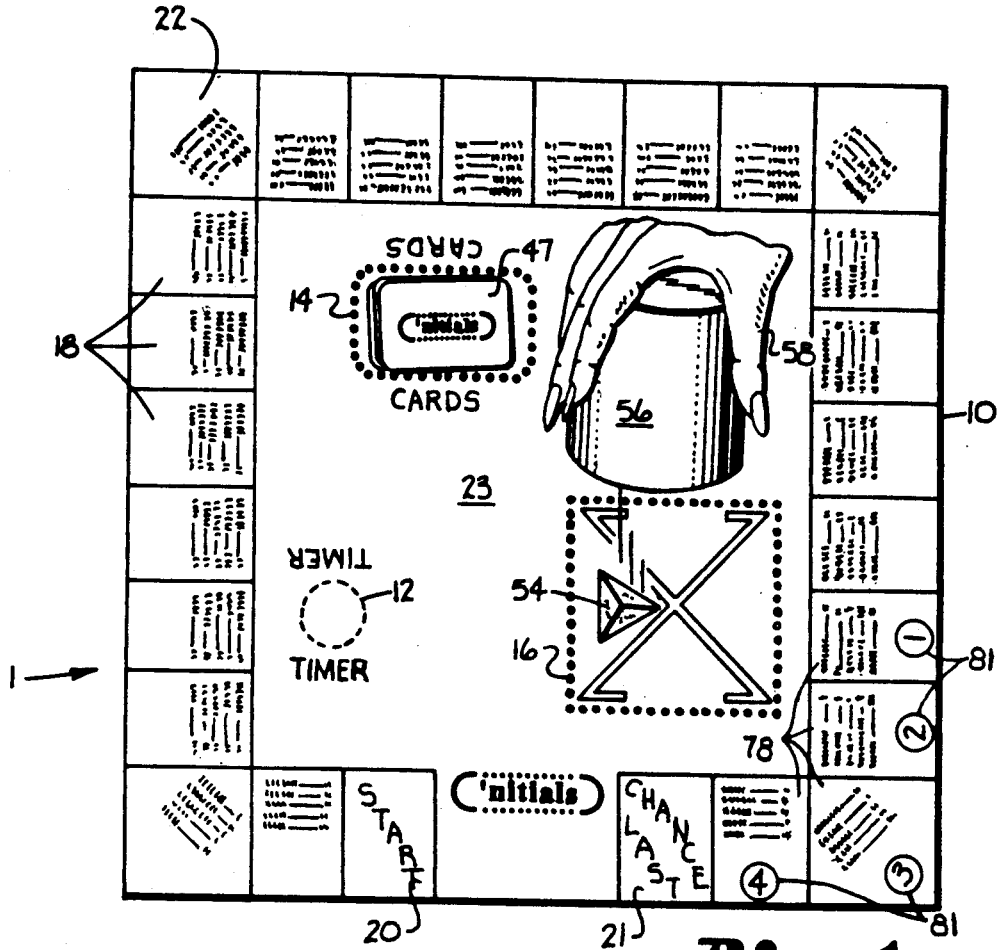
FIG. 1 is a plan view of a game board of a memory game apparatus in accordance with the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The following description is that of a game, generally referred to herein by the reference numeral 1, which shall be known as "NITIALS". The apparatus which is used in the game comprises playing area means, category value selection means, scoring means, initials selection and pairing means, and timing means.

Playing area means, such as a game board 10 as shown in FIG. 1, is comprised of designated areas such as a timer area 12, a cards area 14 and a tossing area 16. In addition, the game board 10 comprises a start space or square 20, a finish or "last chance" space or square 21, and a plurality of adjacently spaced path squares 18 which form a path 22 running substantially around the perimeter of a planar face 23 of the game board 10 connecting the start square 20 with the finish square 21. It is to be understood that the start square 20, the finish square 21, and the path squares 18 do not necessarily have to be geometrically square but may have any other geometric shape desired.

Figure 2:
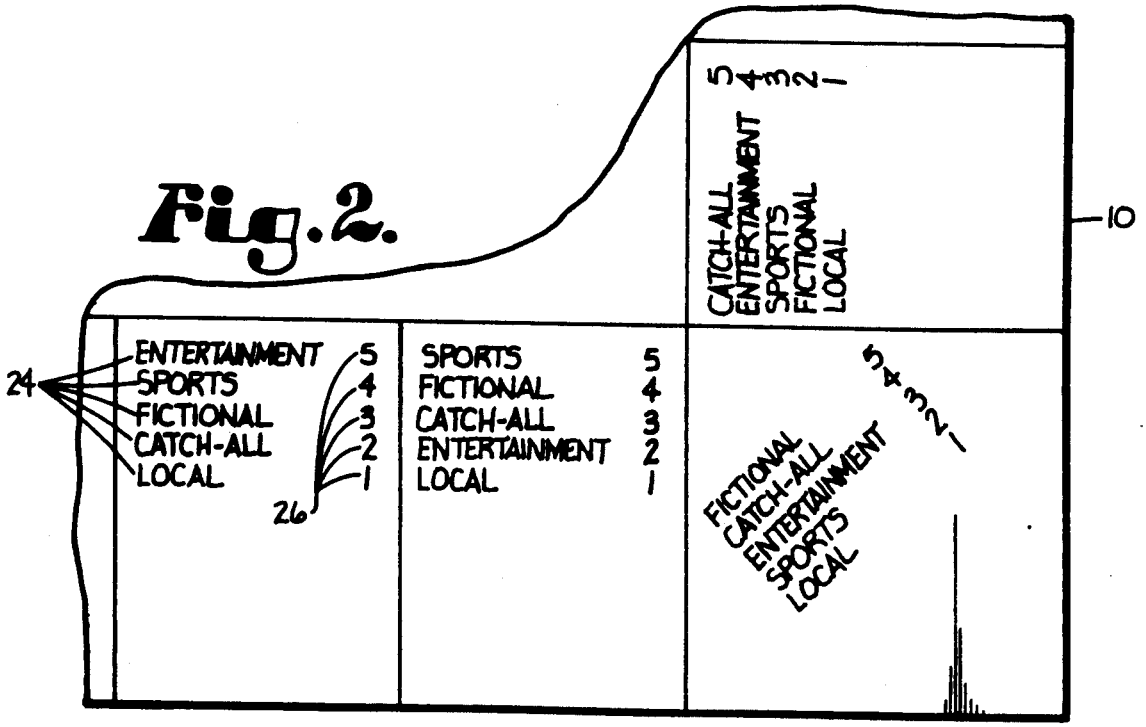
FIG. 2 is an enlarged and fragmentary plan view of the game board of the memory game apparatus.

Category value selection means, such as a plurality of people categories 24, each of which is listed on the squares 18, together with a sliding scale of values 26 for each of the people categories 24, as shown in FIG. 2. Each of the path squares 18 has a unique set of the values 26 which is different from the set of values 26 assigned to each of the other squares 18. The people categories 24 used in one application of the present invention are as follows, together with an explanation of the scope of each such people category 24:

(a) Entertainment—musicians, singers or dancers, actors or actresses, comedians, magicians, and national television personalities;

(b) Sports—collegiate or professional players or coaches, who are known state-wide or nationally;

(c) Fictional—movie or television characters, cartoon or comic characters, nursery rhyme characters, and fictional characters from books or songs;

(d) Catch-All—basically anyone who is famous but who does not fit within any of the foregoing categories, such as politicians, military personnel, historical figures, people in past or present current events, news reporters, authors, sports team owners, media announcers, promoters, famous criminals, and movie or television writers, directors or producers; and (e) Local—persons who are not known state-, nation-, or world-wide but who are known by all participating players, such as neighbors, friends, relatives and local radio or television personalities.

A die 28, such as that shown in FIG. 11, may be used to determine the number of squares 18 which a marker 30, such as that shown in FIG. 10, is advanced to select the values 26 for the people categories 24 for a particular round of play.

Scoring means, such as a score sheet 32 as shown in FIG. 9, is used to tabulate the score of each player participating in the game 1. A plurality of horizontal lines 34 are spaced or aligned vertically on each of the score sheets 32 with a vertically aligned column 35 of alphabetic characters 36 spaced in close proximity to a left margin 37 of the score sheet 32 near the left ends of the lines 34 such that each letter 36 in the column 35 is associated with a different one of the lines 34, as shown in FIG. 9. In one application of the present invention, there are twenty-six of the horizontal lines 34 on each of the score sheets 32 whereat the letter "A" 38 of the alphabet is aligned with the uppermost line 34, such as line 39 in FIG. 9, the letter "Z" 40 of the alphabet is aligned with the lowermost line 34, such as line 41 in FIG. 9, and the remainder of the alphabet, "B" through "Y", respectively, correspond to the innermost twenty-four lines 34 aligned therebetween. Each of the score sheets 32 also contains blanks 42 for recording category values 26 as hereinafter described.

A vertically aligned column 43 of blank boxes 44, equal in number to the number of the alphabetic characters 36 in the column 35, is spaced immediately to the left of the column 35 such that each of the blank boxes 44 is associated with a different one of the alphabetic characters 36. Similarly, a vertically aligned column 45 of blank boxes 46, equal in number to the number of the alphabetic characters 36 in the column 35, is spaced immediately to the right of the column 35 such that each of the blank boxes 46 is associated with a different one of the alphabetic characters 36.

Initials selection means, such as a deck 47 of cards 48 as shown in FIG. 1, each of the cards 48 having a face 49 and a back 50, as shown in FIGS. 3*a* and 3*b*, respectively. The face 49 of each of the cards 48 contains an ordered array or a phrase 52 comprising alphabetic characters 53 equal in number to the number of lines 34 on the score sheet 32. Alternatively, the card face 49 may contain other instructions, such as "all A's", etc. to be used as hereinafter provided.

Initials pairing means, such as a gaming piece 54 and a tumbler 56, is used to respectively associate each one of the alphabetic characters 53 with a different one of each of the alphabetic characters 37 of the score sheet 32. The tumbler 56 is generally cylindrically shaped and sized such that it fits comfortably in a player's hand 58 as shown in FIG. 1. A plurality of ribs 60 rigidly spaced along an inner surface 62 of the tumbler 56 randomizes which face 64 of the gaming piece 54 is spaced against the game board 10 when the gaming piece 54 is tossed from the tumbler 56. Alternatively, an end face 66 of the tumbler 56 can be constructed of transparent material such that the face 64 of the gaming piece 54 can be viewed therethrough.

The gaming piece 54 preferably has four faces 68 with each one of the faces 68 being substantially inscribed with a different one of the following indicia: "on left top to bottom", "on right top to bottom", "on left bottom to top", and "on right bottom to top". Alternatively, a spinner 70 can be used in place of the gaming piece 54 and the tumbler 56 as hereinafter described.

Timing means, such as an hourglass-type timer 72, may be used to control the amount of time for each player's response during each round of play. In one application of the present invention, the period of the timer 72 for the sand to drain from one end of the timer 72 to the other end is approximately three minutes.

In an actual application of the game 1, the marker token 30 is placed on the start square 20 of the game board 10, the timer 72 is placed on the timer area 12, and the deck 47 is shuffled and placed face down on the cards area 14 of the game board 10. One of the players then tosses the die 28 and the marker token 30 is advanced from the start square 20 to one of the squares 18 as indicated by the number exposed on a top face 74 of the die 28. Each player then records, in the blanks 42 of the score sheet 32, the values 26 for the corresponding people categories 24 as designated on the square 18 occupied by the advanced marker token 30. In the example shown, names in the "local" category have a value of 1, with each of the other people categories 24 having a different value ranging from 2 to 5.

After each of the players records the values 26 on his score sheet 32, one of the players draws one of the cards 46 and turns it face up such that the inscription thereon is visible to all participating players. In the example shown, the drawn card 46 has the phrase "THE REMARKABLE MR. PENNYPACKER", which contains exactly twenty-six letters, the same as the number of horizontal lines 34 aligned vertically on the score sheet 32 in the example.

A player then places the gaming piece 54 in the tumbler 56 and tosses the gaming piece 54 onto the game board 10 in the tossing area 16. One of the participating players then picks up the gaming piece 54 and exposes the bottom face 64 thereof to another player who reads the wording thereon aloud. Each player then forms a plurality of pairs of initials on his respective score sheet 32 by inscribing the alphabetic characters 53 which are exposed on the card 48 in either the blank boxes 44 of the column 43 or the blank boxes 46 of the column 45 as instructed by the information read aloud from the gaming piece 54.

The timer 72 is then inverted and each player competitively lists the first and last names of a known person or personality, whose first and last names correspond to the pair of initials at the beginning of each of the lines 34 on the score sheet 32, keeping in mind that a person from one of the people categories 24 may have a higher point value than a person from another one of the people categories 24. The game continues until a player designated as time keeper announces that the time is up for that round. The score for that round is then tallied on each player's score sheet 32.

The game 1 then continues and the marker token 30 is similarly advanced to another square 18 as designated by another roll of the die 28. The score from each round of the game is accumulated to give a total score for each of the players.

The game is continued until either (a) one of the players first passes a pre-determined total score and is declared winner, or (b) the marker token 30 is advanced at least to the "last chance" square 21. In that event, the spinner 70 is flicked to select one of several final-round indicia 80, such as numerals 1, 2, 3, or 4, as shown in FIG. 7, and the marker token 30 is then backspaced from the "last chance" square 21 to one of the four immediately preceding squares 78 which contains a similar final-round indicia 81 corresponding thereto. The last round of the game is then played as hereinbefore described. After completion of the last round of play, the player having the highest cumulative score is declared the winner.

In the event that either the gaming piece 54 or the spinner 70 should become lost or misplaced, the spinner 70 is divided into quadrants 90, one of each of which contains a different one of the indicia: "on the left top to bottom", "on right top to bottom", "on left bottom to top", and "on right bottom to top" so that the spinner 70 can double for the gaming piece 54. Similarly, each face 68 of the gaming piece 54 is inscribed with a different one of the final round indicia 80, as designated by the numeral 92 in FIG. 4, corresponding to the final round indicia 80 on the spinner 70 so that the gaming piece 54 can double for the spinner 70.

Repetitive participation in playing the memory game apparatus 1 of the present invention will enhance one's awareness of acquaintances' initials and thereby improve one's ability to recollect the names of such acquaintances by association of their names with their initials.

It is to be understood that while certain forms of the present invention have been illustrated and described herein, it is not to be limited to the specific forms or arrangement of parts described and shown.

What is claimed and desired to be secured by Letters Patent is as follows:

1. A game apparatus for one or more players to perform a listing of persons having a first and last name which matches one pair of a plurality of pairs of initials, comprising the following:

(a) category value selection means for designating values for various selected people categories;

(b) random selection and pairing means for forming a plurality of pairs of initials;

(c) timing means for designating a time interval for each player's response; and (d) scoring means for tabulating each player's score according to the people category for each person listed by that player.

2. The game apparatus according to claim 1 wherein said category value selection means include:

(a) a game board having a plurality of squares, each of which contains a listing of selected people categories together with a unique set of assigned values therefor;

(b) a marker token for designating a particular one of said plurality of squares; and (c) a die for indicating the number of squares to advance said marker token along said plurality of squares.

3. The game apparatus according to claim 1 wherein said selection and pairing means include:

(a) a score sheet for each player; each of said score sheets comprising:

(1) a plurality of vertically spaced horizontal lines;

(2) a first column comprising a plurality of alphabetic characters; said first column spaced near the left end of said horizontal lines whereat one of each of said alphabetic characters of said first column is associated with a different one of said horizontal lines; and (3) a second column comprising a plurality of blank boxes, equal in number to the number of alphabetic characters of said first column; said second column spaced immediately to the left of said first column whereat one of each of said blank boxes of said second column is paired with a different one of said alphabetic characters of said first column;

(b) a plurality of cards wherein each of said cards comprises an ordered array of alphabetic characters, equal in number to the number of alphabetic characters of said first column, for respectively recording one of each said alphabetic character of said array in a different one of said blank boxes of said second column.

4. The game apparatus according to claim 3 wherein said selection and pairing means further include:

(a) a third column comprising a plurality of blank boxes, equal in number to the number of alphabetic characters of said first column; said third column spaced immediately to the right of said first column whereat one of each of said blank boxes of said third column is paired with a different one of said alphabetic characters of said first column; and (b) a gaming piece having four faces having substantially one of each of the following indicia inscribed on a different one of said faces:

(1) "on left top to bottom", (2) "on right top to bottom", (3) "on left bottom to top", and (4) "on right bottom to top".

5. The game apparatus according to claim 3 wherein said selection and pairing means further include:

(a) a third column comprising a plurality of blank boxes, equal in number to the number of alphabetic characters of said first column; said third column spaced immediately to the right of said first column whereat one of each of said blank boxes of said third column is paired with a different one of said alphabetic characters of said first column; and (b) a spinner having four quadrants whereat substantially one of each of the following indicia is inscribed on a different one of said quadrants:

(1) "on left top to bottom", (2) "on right top to bottom", (3) "on left bottom to top", and (4) "on right bottom to top".

6. The game apparatus according to claim 1 wherein:

(a) said timing means include an hourglass-type timer.

7. The game apparatus according to claim 6 wherein:

(a) said timer has a period of approximately three minutes.

8. A memory game apparatus comprising:

(a) a game board comprising the following indicia on one planar surface thereof:

(1) a start square;

(2) a finish square; and (3) a plurality of adjoining squares forming a path running along the periphery of said game board such that said path connects said start square to said finish square; each said square in said path comprising a list of selected people categories together with a sliding scale of values for said people categories; each of said squares having a unique allocation of said sliding scale of values for said people categories; each of four of said squares immediately preceding said finish square containing individually distinct final-round indicia;

(b) a marker token;

(c) a die for indicating the number of squares to advance said marker token along said path of squares;

(d) a score sheet comprising the following indicia on one planar surface thereof:

(1) a plurality of vertically spaced horizontal lines;

(2) a first column comprising a plurality of vertically spaced alphabetic characters equal in number to the number of said vertically spaced horizontal lines; said first column spaced near the left ends of said vertically spaced horizontal lines whereat each one of said alphabetic characters is associated with a different one of said vertically spaced horizontal lines;

(3) a second column comprising a plurality of vertically spaced blank boxes; equal in number to the number of said alphabetic characters in said first column; said second column spaced immediately to the left of said first column such that each one of said blank boxes of said second column is associated with a different one of said alphabetic characters of said first column;

(4) a third column comprising a plurality of vertically spaced blank boxes, equal in number to the number of said alphabetic characters in said first column; said third column spaced immediately to the right of said first column such that each one of said blank boxes of said third column is associated with a different one of said alphabetic characters of said first column; and (5) a plurality of blanks for recording said scale of values for said people categories for a given round of play;

(e) a deck comprising a plurality of cards wherein each of said cards comprises an ordered array of alphabetic characters, equal in number to the number of said alphabetic characters in said first column, inscribed on one planar face thereof;

(f) a gaming piece having four faces so that each of said faces is inscribed with a different one of said four final-round indicia; each of said faces is further substantially inscribed with a different one of the following:

(1) "on left top to bottom", (2) "on right top to bottom", (3) "on left bottom to top", and (4) "on right bottom to top";

(g) a tumbler having a plurality of ribs for tossing said gaming piece;

(h) a spinner having four quadrants such that each of said quadrants is inscribed with a different one of said four final-round indicia; each of said quadrants is further substantially inscribed with a different one of the following;

(1) "on left top to bottom", (2) "on right top to bottom", (3) "on left bottom to top", and
(4) "on right bottom to top"; and
(i) a timer for allotting a certain amount of time for each round of play.

9. A method of playing a memory development game by one or more players, comprising the steps of:
(a) first randomly selecting a sliding scale of values for certain people categories and randomly selecting a plurality of pairs of alphabetic characters;
(b) then competitively recording the names of known persons, each of whom have initials matching one pair of said plurality of pairs of alphabetic characters during a given interval of time; and
(c) then totaling the score of each player by summing the values of each of the recorded names as respectively indicated by the selected values for the appropriate people categories.

10. A method of playing a memory development game wherein the memory development game is comprised of a game board having a plurality of adjacently spaced squares around a perimeter of a planar face of said board with one of said squares being a start square, another of said squares being a finish square, and the remainder of said squares forming a path between said start square and said finish square, each of said remainder of said squares having indicia thereon designating a list of various people categories together with a sliding scale of values therefor, a marker token, a die, a timing device, a score sheet having a certain quantity of horizontal lines aligned vertically thereon with each such line having indicia comprising a different letter of the alphabet spaced near the left end of each such line, a plurality of shuffled cards having indicia thereon designating an ordered array of alphabetic characters equal in number to the quantity of lines on said score sheet, and a gaming piece, the method of play comprising the steps of:
(a) tossing the die and advancing the marker token from the start square on the game board to a second square on the game board according to a number indicated by the tossed die;
(b) drawing a card from the plurality of cards to randomly select an array of alphabetic characters;
(c) using the gaming piece to determine the manner in which the array of alphabetic characters of the drawn card are to be respectively combined with the alphabetic characters of the score sheet to form a plurality of pairs of initials on the score sheet;
(d) starting the timing device to establish a set period of time for a round of play;
(e) each player competing with each other player to list the names of known persons whose first and last names correspond to a different one of the pairs of initials on the score sheet;
(f) determining the score for each person listed by each player based on the value of the people category for that listed person as provided by the indicia on the square on the game board occupied by the marker token; and
(g) repeating steps (a)–(f) for each successive round of play with a last round of play occurring when the marker token reaches the finish square on the game board, then determining a total accumulated score for each player for all rounds of play and the player having the highest total score being the winner.

* * * * *